United States Patent [19]

Roeser et al.

[11] Patent Number: 4,929,808

[45] Date of Patent: May 29, 1990

[54] ELECTRICAL SWITCH COMPONENT AND SWITCHES FORMED THEREBY

[75] Inventors: John O. Roeser, Barrington; Bruce L. Graham, Schaumburg, both of Ill.

[73] Assignee: Otto Engineering, Inc., Carpentersville, Ill.

[21] Appl. No.: 366,146

[22] Filed: Jun. 13, 1989

[51] Int. Cl.[5] ..... H01H 5/08

[52] U.S. Cl. ..... 200/467; 200/462

[58] Field of Search ..... 200/467, 462, 48 KB, 200/452, 460, 461, 275

[56] References Cited

U.S. PATENT DOCUMENTS

| | | | |
|---|---|---|---|
| 3,073,923 | 1/1963 | Anderson | 200/67 |
| 3,141,075 | 7/1964 | Brevick | 200/67 |
| 3,242,281 | 3/1966 | Brevick | 200/67 |
| 3,265,823 | 8/1966 | Bury | 200/67 |
| 3,337,702 | 8/1967 | Brevick | 200/67 |
| 3,382,332 | 5/1968 | Cherry | 200/67 |
| 3,400,234 | 9/1968 | Long | 200/67 |
| 3,432,632 | 3/1969 | Schenke | 200/67 |
| 3,449,538 | 6/1969 | Long | 200/160 |
| 3,485,975 | 12/1969 | Long | 200/67 |
| 3,612,793 | 10/1971 | Roeser | 200/284 |
| 3,995,129 | 11/1976 | Michalski | 200/67 |
| 4,011,419 | 3/1977 | Anderson | 200/67 B |
| 4,272,660 | 6/1981 | Mayer | 200/83 P |
| 4,342,885 | 8/1982 | Kashima | 200/47 |
| 4,673,778 | 6/1987 | Lewandowski | 200/67 B |

FOREIGN PATENT DOCUMENTS

| | | | |
|---|---|---|---|
| 464406 | 4/1945 | Canada | 200/67 B |
| 58076 | 10/1911 | Switzerland | 200/67 B |
| 829965 | 3/1960 | United Kingdom | 200/67 B |

*Primary Examiner*—Henry J. Recla
*Assistant Examiner*—Keith Kupferschmid
*Attorney, Agent, or Firm*—Robert D. Silver

[57] ABSTRACT

A precision switch and a switch blade/contact formed from uniform thickness sheet stock bent into U-shaped form wherein the edge surfaces after bending become the movable contacts of the high performance rugged tiny subminiature switch. The switch per se utilizes a configuration of pivotal rigid legs of the U-shaped blade/contact arranged to be spaced apart to maximum extent to allow a large diameter long coil spring located between the legs to be used for giving the blade/contact means precision high contact force operating characteristics which will withstand high G forces and will carry relatively large currents given the absolute size of the switch.

34 Claims, 4 Drawing Sheets

ELECTRICAL SWITCH COMPONENT AND SWITCHES FORMED THEREBY

BACKGROUND

This invention is concerned with the electrical switch art and more particularly with components in snap action mechanisms, the forming thereof and the mechanisms formed thereby.

More specifically this invention relates to a precision compact elegant combination switch blade and contact means which is exceedingly useful in snap switch mechanisms—particularly very tiny switch mechanisms which are denominated as being subminiature or sub-subminiature and the switch formed using the combination switch blade and contact means. (It is to be noted that the terms subminiature and sub-subminiature are inexact and cover a wide and overlapping range of sizes. The term "subminiature" will be used hereafter to denominate those switches which are among the smallest mechanically actuatable switches.)

Subminiature switches have been made heretofore. However these prior art subminiature switches do not fall in the category of being "high performance" switches. They are deficient in not being able to meet one or more of the following characteristics —relatively large current capacity (1 Amp. resistive at 28 vdc or 115 vac, 60 Hz); high precision (movement differentials, pretravel, overtravel, all measured in terms of thousandths of one inch); ruggedness (able to withstand major shock forces, temperature extremes, tens of thousands of actuations, etc.) and reliability even when exposed to momentary short circuits of 50 or more times rated current carrying capacity.

It is the nature of switching of electrical currents that there is a migration of the physical material of which the contact areas are comprised upon making and breaking of contact. Heat is also generated upon making and breaking due to arcing. The amount of degradation of the contact areas by the heat and migration of the contact material is, among other things, a function of the cross-sectional areas involved and in the amount of current passing or being switched. The higher the current density the greater the degradation upon switching. The smaller the switch the more difficult it is to prevent severe contact surface degradation or even welding of the contact surfaces.

In small switches of the subminiature size it is very difficult to have a relatively high current carrying capacity and provide sufficient mass in the movable contact to accept the inherent erosion of the contact surface while providing heat conduction away from the contact area. Subjecting prior art switches to short circuit currents of 50 amps or more for a millisecond or more, as called for in standard military specification tests, generally causes severe degradation or destruction of the switches. Also repeated switching of one amp. of current at useful ranges of 28 vdc or 115 vac, 60 Hz also causes denigration of the contact surfaces to the point of unacceptable contact resistance ranges.

An important factor in high precision, tiny, rugged switches is the construction of the movable contact member. Another significant factor is the contact force between the contacting surfaces after switching. The force is applied to the movable contact to cause it to remain in switched position so as to be able to withstand vibration and extreme shock. The means by which force is applied to the movable contact as well as the construction of the movable contact per se are important areas of precision high performance switches.

In sizes larger than subminiature, two general types of snap action switches of the high precision high performance momentary single break type are presently extant in the prior art. One type is the flexible flat blade type having compression and tension arms with an actuator engaging the tension arms to cause an overcentering action of the movable contact mounted on the end of the blade. The prior art blade is less than 0.002 inches thick in the very small switches, and does not have enough cross section area for carrying current, particularly for meeting short circuit specification testing.

The other type of prior art blade is used with a coil spring and is a generally rigid pivotal contact carrying member, the cooperation being such that an actuator engages the coil spring to cause the line of action of the spring to overcenter and thereby move the movable contact mounted on the rigid contact carrying member. The coil spring type of switch has an advantage of being able to apply substantially more force to the movable contact in both its at rest position and when it has been moved to its overcentered position. This contact force is important to give the characteristic of ability to withstand extreme conditions of shock and vibration. The contact force also is important in preventing contact degradation. However and importantly, mere downsizing of these larger than subminiature size switches does not provide an acceptable high performance product of subminiature size.

Pivotal action coil springs for moving a momentary switch pivotal movable contact member, and of the single break type where the actuator actually engages the coil spring, have been known for almost 80 years. In the 1950's more modern versions of electrical switches were developed as exemplified by F. N. Anderson et all, Pat. #3,073,923 which issued Jan. 15, 1963. The switches of this type were variously refined over time and the most recent and sophisticated is of the type shown in Lewandowski et al, Pat. #4,673,778 issued June 16, 1987 and assigned to the Cherry Corporation of Waukegan, Ill. This latest Cherry switch, while well designed and sophisticated, cannot be properly called a high performance switch in that it cannot withstand rugged electrical or mechanical environments and cannot handle high currents with precision. Nor will the beefing up of the switch provide a rugged high performance switch.

In December of 1969 a military specification MIL S 8805/94(AR) was published for a very tiny general purpose high precision subminiature switch, which specification incorporates and refers to Mil S 8805 as updated from time to time, and which in turn incorporates several other specifications and standards. This specification 8805/94 sets forth requirements for a very tiny high performance snap action switch. For the 19 years since its publication, the 8805/94 specification has never been successfully approached and further, the industry has not provided a switch of slightly modified specifications but meeting the essential criteria contained in 8805/94.

The 8805/94 switch requirements called for a tiny in physical size switch which, excluding the terminals and the movable operating button, have an outer envelope dimensions of 0.100 inches plus or minus 0.007 inches in width; 0.300 plus or minus 0.010 inches length; and a height of 0.250 inches plus or minus 0.025 inches when including the raised cover area surrounding the actuator button. The electrical specification requires the ability to switch at least 1 Ampere resistive (0.5 Amperes inductive) at 28 vdc and 115 vac, 60 Hz at sea level with an electrical endurance of 25,000 cycles. In addition there is a requirement of a mechanical endurance of 100,000 cycles with a contact resistance after 25,000 cycles not to exceed 25 milliohms. After 100,000 cycles the contact resistance must not exceed 40 milliohms. The specification requires that the switch withstand defined very short durations of short circuits of 100 Amps. at 6 vdc and remain operative as defined.

The somewhat conflicting concepts of tiny but rugged is exacerbated by the additional requirements that the switch also must be able to withstand 100 G forces of shock, be able to meet vibration tests through a range of 10 through 2,000 Hz and be operable over a temperature range of 180 degrees Centigrade (−55C to +125C). The distances between contact surfaces and the discrete current carrying portions of switch must be maintained in electrically separate relationships so that there is a sea level dielectric to withstand a voltage of 1000V RMS. When it is also considered that 332 separate switches must in aggregate weigh less than one pound (the weight specification maximum is 0.003 lbs.), the difficulty of meeting the diverse specification requirements come into focus. High performance operating characteristics also obtain in that it is required that the switch must switch current with a maximum actuating force of 4 ounces, a releasing force of 7/10 of an ounce and that a movement differential be provided of 4/1000 of an inch or less, a pretravel of at least 15/1000 of an inch and there be a minimum of 3/1000 of an inch of overtravel (and more would be desirable).

Packing of all these electrical, mechanical and environmental requirements into such a tiny physical package with such high precision operating characteristics has been a formidable task for the industry. Prior hereto, despite need, no close approach to the specification 8805/94 has been provided. It is believed that one of the main problems has been to provide a switch of this tiny size which can meet the switch electrical current characteristic of 1 Amp. Another obstacle in this size switch is meeting the momentary high amperage short circuit specification characteristics without significant degrading of the contacts. Some switch configuration attempts, when prior art types of downsized relatively standard blade constructions were attempted (both flexible blade and coil spring operated), turned into what might be called a non calibrated fusible link when exposed to the high amperage short circuit requirements. In essence the whole movable contact blade mechanism melted.

A further sizable problem is to pack all of the very high precision movable parts in such a tiny space, while meeting the precision operating characteristics and simultaneously providing sufficient heft to meet the mechanical objectives of the specification.

A search was conducted on the subject matter herein and the following references were developed:

| Date | Patent No. | Inventor/Assignee |
|---|---|---|
| 10/16/11 | 58076 (Swiss) | Brevet/Ph. Morand & Fils |
| 4/18/45 | 464,406 (Canada) | Gratzmuller |
| 3/9/60 | 829,965 (G. Br.) | Leney |
| 1/15/63 | 3,073,923 | Anderson-Cherry/Cherry Electrical Products Corp. |
| 7/14/64 | 3,141,075 | Brevick-Cherry/Cherry Electrical Products Corp. |
| 8/9/66 | 3,165,823 | Bury/Illinois Tool Works |
| 8/22/67 | 3,337,702 | Brevick-Cherry.Dernehl/Cherry Electrical Products |
| 5/7/68 | 3,382,332 | Cherry-Grady/Cherry Electrical |
| 9/3/68 | 3,400,234 | Long/Cherry Electrical |
| 3/11/69 | 3,432,632 | Schenke/Firma J & J Marquardt |
| 6/10/69 | 3,449,538 | Long/Cherry Electrical |
| 12/23/69 | 3,485,975 | Long/Cherry Electrical |
| 10/12/71 | 3,612,793 | Roeser/Otto Engineering |
| 11/30/76 | 3,995,129 | Michalski/Rudolf Schadow GmbH |
| 3/8/77 | 4,011,419 | Anderson/Cherry Electrical |
| 6/9/81 | 4,272,660 | Mayer-Pescetto/Stewart Warner |
| 8/3/82 | 4,342,885 | Kashima-Takase-Mishina/ Matsushita Electric Works |
| 6/16/87 | 4,673,778 | Lewandowski-Doros-Redfield/ The Cherry Corporation |

All of these references are of general interest and the three superficially closest references developed are the Cherry switch shown in 4,673,778, the Roeser/Otto Engineering switch (FIG. 17) shown in 3,612,793 and the Michalski switch 3,995,129. The 4,673,778 and the 3,995,129 do not show or teach high performance switches, nor can they be modified in any reasonable manner so as to meet high performance standards aforenoted. The Otto Engineering switch is a high performance switch but cannot be downsized to the substantially smaller switch herein and cannot be modified so as to meet the criteria above discussed without a complete change in structure and relationships.

SUMMARY OF THE INVENTION

With the above in mind it is the object of this invention to provide an elegant tiny rugged subminiature switch component an switch device formed therewith which will carry a relatively large current when considering the size of the component and switch.

The invention features a unitary combination switch blade and contact means for a tiny rugged relatively large current carrying high precision snap switch of length less than one third of an inch and width less than one eighth of an inch, said unitary combination switch blade and contact means having a material thickness turned on edge so that the height of such unitary switch blade and contact mean is substantially greater than the material thickness.

It is the object of the invention to provide a generally U-shaped configuration combination switch blade and contact means where the aforementioned height portion that is substantially greater than the thickness of the material is formed with a spring attachment means which is approximately coterminus with the plane of the contact portion whereby a coil spring with more active coils may be used.

It is a further object of the invention to have a U-shaped configuration unitary combination switch blade and contact means having a pair of leg portions connected by a bail portion, the bail portion being the contacts and having a substantial mass so as to accommodate to some material erosion during the life of the switch and having sufficient mass to rapidly conduct away the heat generated upon make and break of a relatively large current considering the absolute size of the switch to which it will be associated.

The switch discussed below packs the operating parts in assembled relation internally of an envelope having a cubic interior space of approximately 78/1000 of an inch by 110/1000 of an inch by 281/1000 of an inch (all dimensions being at extreme of maximum tolerances).

The method of forming the switch utilizes the pull/-stretch action of the shearing edge of the stamping tool to form important curvilinear surfaces on the combination switch blade and contact carrying member, i.e. at the V shaped pivotal ends and at the spring engaging web between two slots in the bail portion of the U-shaped combination switch blade and contact carrying member. These curvilinear surfaces provide low friction surfaces for engagement respectively with the cover and the spring as shall be described. The same concepts are also used in forming the spring engaging attachment surfaces of the yoke.

The switch to be described is able to meet the difficult electrical, mechanical and operating characteristics aforenoted by the utilization of a novel unitary combination switch blade and contact means with other novel components and to be described novel relationships.

This novel switch blade and contact means made by the methods described herein, and when combined with other components when formed and assembled in a particular novel method and array, provides a truly rugged tiny large current carrying capacity subminiature switch which may be manufactured by mass manufacturing techniques and by utilization of relatively unskilled labor, and is otherwise well adapted for its intended purpose. Other objects and novel inventive relationships will become apparent from reading the below specification, claims and study of the drawings.

DETAILED DESCRIPTION OF THE DRAWINGS

Figure 1:
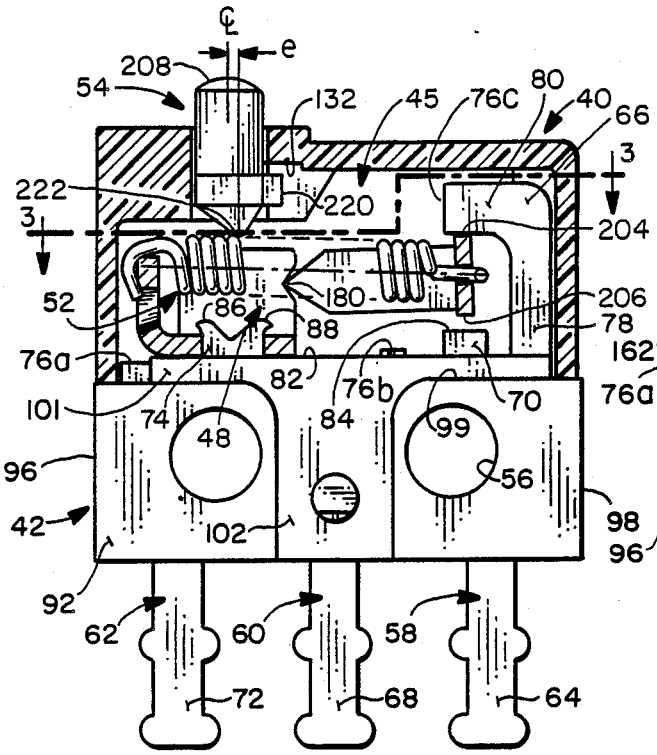
FIG. 1 is a side elevational view, partially in section, showing the novel unitary switch blade assembled in a subminiature switch in the nonactuated state.
Figure 2:
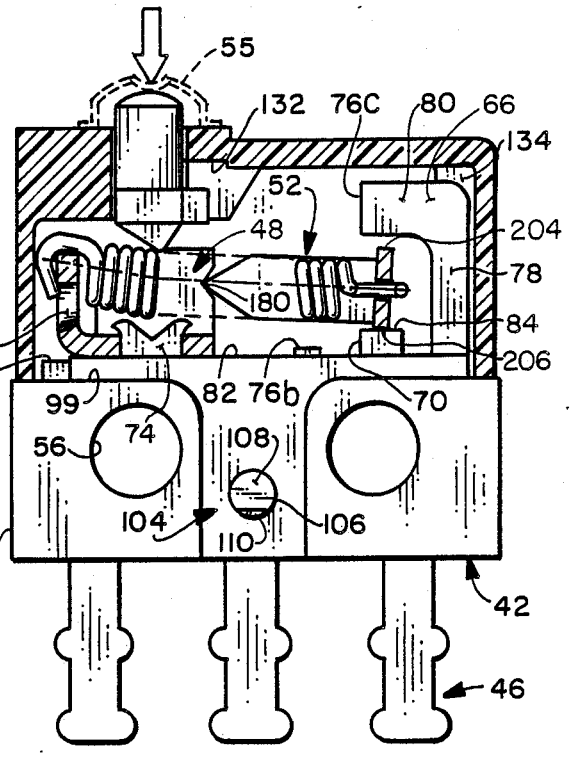
FIG. 2 is a partial sectional view similar to FIG. 1 showing the parts in an actuated array.
Figure 3:
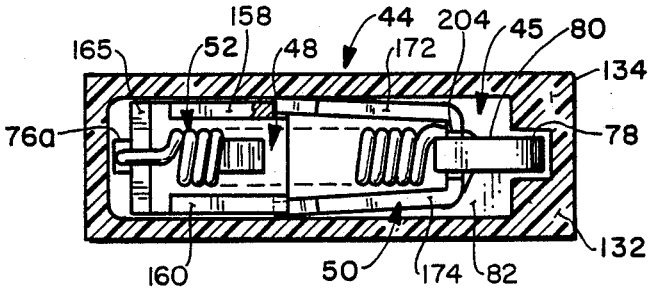
FIG. 3 is a sectional view along lines 3—3 of FIG. 1.
Figure 4:
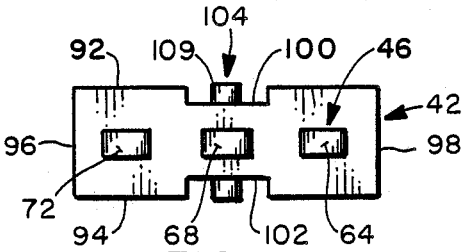
FIG. 4 is a bottom view of the switch base prior to the assembly of the yoke, coil spring, movable switch blade/contact and cover/actuator along lines 4—4 of FIG. 5.
Figure 6:
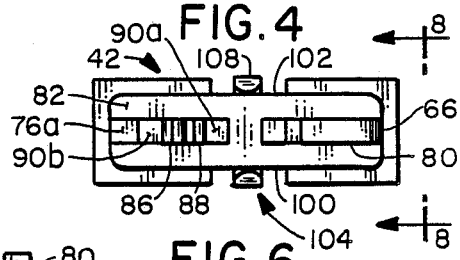
FIG. 6 is a top view of the base of FIGS. 4 and 5.
Figure 5:
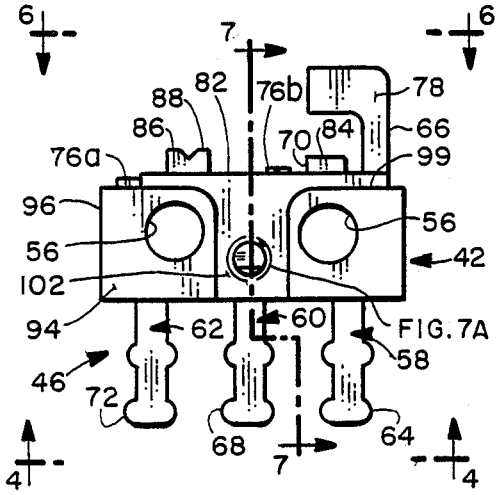
FIG. 5 is a side elevational view of the base of FIG. 4.

As shown in FIGS. 1, 2 and 3, the components when assembled together form a subminiature unitary snap switch means 40. The drawings, FIGS. 1, 2 and 3 are shown approximately ten times actual size.

Figure 29:
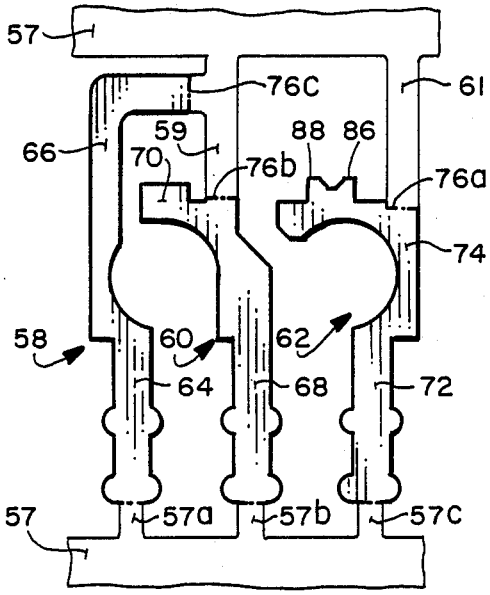
FIG. 29 is a plan view of the fixed contact stamping prior to molding with the base.

The snap switch means 40 comprises base means 42, cover means 44, fixed terminal means 46, yoke means 48, combination switch blade and contact means 50, coil spring means 52 and actuator means 54. The base means 42 and the fixed terminal means 46 are preferably molded as a unit. The fixed terminal means 46 are made as a unit in continuous strip form as shown in FIG. 29, and when removed from the molding machine are sheared off in a post molding operation to provide a configuration essentially as shown in FIGS. 4, 5, 6 and 7 (they are connected together by scrap strip stock to be described respecting FIG. 29 prior to the shearing each from the other). The cover means 44 is shown in isolation in FIGS. 10, 11, 12 and 13. The yoke means is shown in isolation and prior to assembly in FIGS. 14, 15 and 16. The actuator (button) means 54 is shown in isolation in FIGS. 17, 18, 19 and 20; and the preferred embodiment of the combination switch blade and contact means 50 is shown in isolation in FIGS. 21, 21A, 22 and 23. The coil spring means is shown only in FIGS. 1-3 and is not shown in isolation.

As best seen in FIGS. 4-9, the base means 42 is essentially rectilinear in configuration and has a pair of spaced through bores 56 for mounting purposes. The base means 42 has first, second and third fixed terminal/contact means 58, 60 and 62 integrally molded therewith. The first fixed terminal/contact means 58 is the upper normally closed switch contact, the second fixed terminal/contact means 60 is the lower normally open contact of the assembly and the third fixed terminal/contact means 62 is a part of the common contact/movable contact means of the assembly. The exterior portions 64, 68 and 72 of the respectively fixed terminal/contact means 58, 60 and 62 are shown with a double turret type of connection means, it being appreciated that this type of connection means is to be considered illustrative only, there being many types and shape forms of exterior terminals as is well understood in the art.

Figure 9:
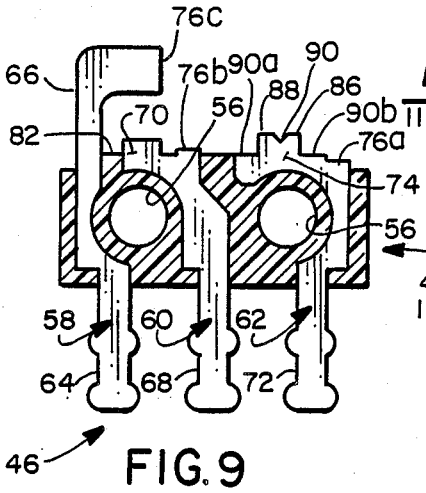
FIG. 9 is a sectional view along lines 9—9 of FIG. 8.

As best seen in FIG. 9, each of the fixed terminal/-contact means 58, 60 and 62 also have respective interior portions 66, 70 and 74. They are preferably made by stamping from a single ribbon of sheet stock 57 in connected relationship to each other as shown in FIG. 29. The exterior ends of turret connection means 64, 68 and 72 for the fixed terminal/contact means are defined by shearing the connections to the sheet stock 57 at points 57*a*, 57*b* and 57*c* as shown. The sheet stock 57 is approximately 0.02 inches thick.

When the base 42 is being molded, the first, second and third terminal/contact means, 58, 60 and 62 as aforementioned, are tied together by scrap sheet stock connection strips 59 and 61 so that the three fixed terminals are in precise dimensional and spatial relationship each to the other and to the base mean 42 during the molding process. After molding, the shearing action takes place to separate at the shear/connection points denominated 76*a*, 76*b* and 76*c*, it being appreciated that subsequent to molding, the strips 59 and 61 are cut away so as to leave the three fixed terminal/contact means in the shape and array as best shown in FIG. 9. There is great importance to having high precision low tolerance dimensional relationships of the terminal/contact means 58, 60 and 62 to each other and to the base means 42 and cover means 44 so that operating characteristics will be maintained from switch to switch. Precision in pretravel, overtravel and operating movement differential depend upon precision location of the actuator relative to the fixed contacts and to the other parts of the switch.

The flat sheet stock 57 of which the terminal/fixed contacts 58, 60 and 62 are made, may be, for example, raw coin grade silver (90% silver, 10% copper) and may or may not, depending on user needs, have gold flash or gold plate as called for in various military specifications. The connecting point 76*a*, as best shown in FIG. 9, is purposefully located below the plane of surfaces 90*a* and 90*b* of the terminal/contact means 62 so as to not interfere with assembly of the yoke means 48 to surfaces 90*a* and 90*b* as shall become apparent.

The interior portion 66 of the first fixed terminal/-contact means 58 is formed with a vertical portion 78 and a horizontal portion 80. The horizontal portion 80 is the upper fixed normally closed contact of the switch. It will be seen that the vertical extent of the horizontal portion 80 as viewed in FIG. 1 is slightly greater than the material thickness and is relatively sturdy. The underside of the vertical portion 80 is the upper contact surface of the snap switch means 40. The relatively large mass of silver/copper metal and the composition of the portions 78 and 80 afford relative fast conduction of heat from the portion 80 to the exterior portion 64 and to the wires (not shown) to which the exterior portion will be connected. Heat is always associated with non super conducting electrical switch components, both at interruption of the electrical current and due to the resistive aspects (Joules losses) of passage of current. Interruption of the current provides arcing. In tiny switches, getting the heat quickly away from the contact area and into the exterior terminals and the heat sink provided by the exterior wires (not shown) is important to long mechanical and electrical switch life.

Figure 7:
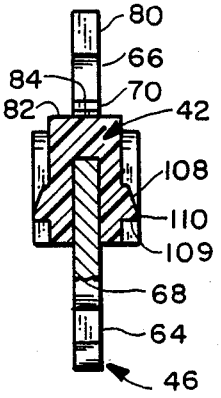
FIG. 7 is a sectional view along lines 7—7 of FIG. 5.

The interior portion 70 of the second fixed terminal/-contact means 60 has two portions raised above the horizontal top surface 82 of the base means 42, the lower contact portion 84 and the aforementioned cut off portion 76*b*. It will be noted that the width of portion 84 as viewed in FIG. 1 is approximately twice the thickness as shown in FIG. 7 to provide contact material mass. The upper fixed contact 80 lower surface is spaced from the upper surface of lower fixed contact 84 a dimension on the order of 0.063 inches which defines the vertical area in which the movable contact means 50 physically occupies the space, however there must also be sufficient margin left over so that the movable contact may move from its "made" position to interrupt and break the current flow during maximum rated electrical stress. Also after break, the unitary combination switch blade and contact means 50, must for dielectric purposes, be spaced from a fixed contact. This spacing is necessary to prevent arcing under extreme vibration, shock, temperature extremes and altitude extremes of the Mil Spec MIL S 9804/94 (AR). The 0.063 inch area between the contacts is very tiny in vertical extent to accommodate both the needed contact mass of the movable contact and the dielectric spacing necessary to prevent arcing after movement thereof.

The interior portion 74 of the third fixed terminal/-contact means 62 as shown in FIG. 9 is initially formed with a rectilinear upstanding portion 90 which in turn has a pair of upstanding ear portions 86 and 88 which are spread apart during assembly to fixedly mount the yoke means 48. It will be noted that the interior portion 74 has a planar surface 90*a* and 90*b* on either side of the upstanding portion 90, the portions 90*a* and 90*b* providing a precision surface to mount the underside of the yoke means 48 for both vertical and for horizontal locational precision. The four rectilinear surfaces of portion 90 provide horizontal assembly positional precision to a mating opening in the yoke means 48 as shall be apparent.

The base means 42 is preferably made of a high grade (A130) liquid crystal polymer dielectric material which has high strength and may be molded to exquisite precision. It is necessary that the material hold its dimensions over a wide range of conditions. One such polymer with the necessary criteria is sold under the trade name VECTRA. The cover means 44 is preferably made of this same material.

The base means 42 is formed with a pair of side surfaces 92–94, end surfaces 96 and 98 and a horizontal cover engaging seat surface 99 which together with top surface 82 defines an offset vertical shoulder 101. The surface 99 must be kept in precise relationship to surfaces 82, 90*a*, 90*b* and contact portions 80 and 84. When the cover means 44 depending edges seat on surface 99, actuator means 54 mounted on the cover means 44 can have precise movement (pretravel, overtravel and movement differential) relative to contact portions 80 and 84. The side surfaces 92 and 94 of the base means 42 are interrupted by shallow oppositely disposed centrally located recesses 100 and 102 coextensive the vertical height of base means 42.

Figure 7A:
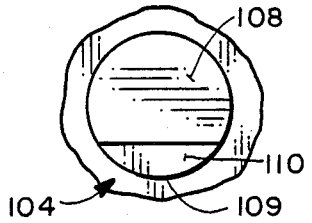
FIG. 7A is an enlarged partial view of a detail on the base.
Figure 8:
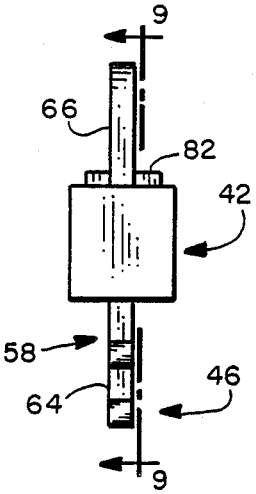
FIG. 8 is an end elevational view along lines 8—8 of FIG. 6.

The recesses 100 and 102 are adapted to receive mating legs 112 and 114 of cover means 44, the legs 112 and 114 having a shape that snugly fits into side recesses 100 and 102. Attachment means 104 for assembly/latching-/holding the cover means 44 to the base means 42 is shown in enlarged view in FIG. 7A. As shown it has a cylindrical outer surface 106, a downwardly sloping cam surface 108, a back up portion 110 and a location area 109 on the cylindrical surface opposite to the cam surface.

Location surface area 109 should be held within plus or minus 0.001 inches tolerance relative to surface 99 to assure tight seating of the cover means 44 to the base means 42. During assembly, cam surface 108 aids in spreading the cover legs 112 and 114 and surface 110 defines the vertical extent of extra back up stock so that there is heft in the latching means 104 so that the assembly of the legs 112 and 114 does not distort surface 109 out of its precision tolerances. This construction affords easy mold adjustment for wear. When molds and dies are used over time, some tiny precision areas tend to wear or get out of tolerance. This latching pin construction will allow an easy substitution of a slightly larger pin bore to be made in the die and substituted for an existing worn latching pin bore therein. Obviously the pin for molding the latching bore in the cover means 44 legs 112 and 114 for mating coaction with the attachment means 104 would have to be enlarged at the same time.

Figure 10:
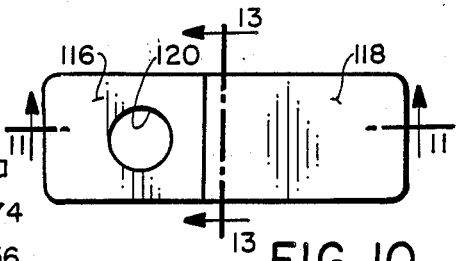
FIG. 10 is a top view of the cover shown in isolation.
Figure 11:
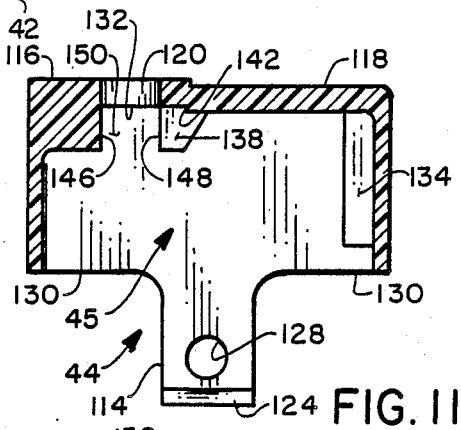
FIG. 11 is a sectional view of the cover along lines 11—11 of FIG. 10.
Figure 13:
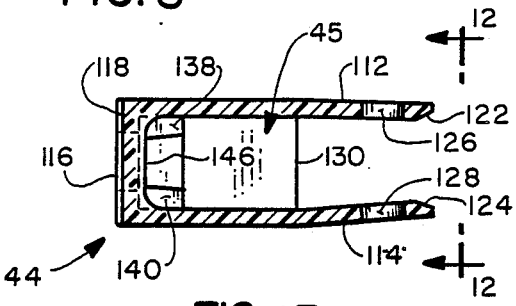
FIG. 13 is a sectional view along lines 13—13 of FIG. 10.
Figure 12:
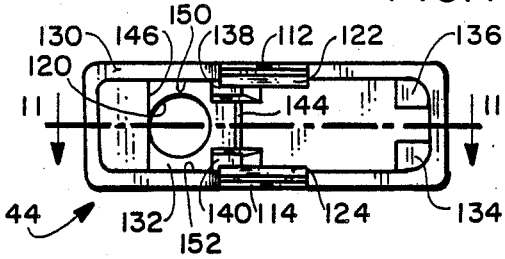
FIG. 12 is a bottom view of the cover along lines 12—12 of FIG. 13.

The cover means 44 is generally rectilinear in top view as shown in FIG. 10 having a stepped raised top portion 116 and planar portion 118 which is suitable for marking indicia as will be understood. A bore 120 for receipt of the actuator means 54 is centrally located in portion 116, the position of bore 120 being dictated more because of specification requirements than by functional requirements. As shown in FIG. 13, the legs 112 and 114 are molded so as to be initially slightly inclined toward each other so that when "sprung" during assembly, they will tightly rest within side recesses 100 and 102 of the base means 42.

Internally of the cover means 44 is a chamber means 45 which, when cover edge surface 130 is seated on shoulder surface 99 of the base means, defines the switch chamber. Surface 130 must be held to very close tolerances (plus or minus 0.001 inches) relative to interior actuator button engaging surface 132 so that the "at rest" vertical position of the actuator means 54 may be precisely locationally defined.

The interior end/side wall of one end of the cover means 44 may have a pair of spaced strengthening struts 134 and 136 which terminate so as to rest on surface 82 of the base means 42. They add physical strength to the cover means and are spaced apart sufficiently s that vertical portion 78 of the terminal/contact means 58 may fit therebetween as shown in FIG. 3. The interior side of the top surface of the cover means is formed with spaced anti rotation depending lugs 138 and 140 for cooperation with the actuator button. Each of the lugs is slightly tapered for dual purposes of allowing mold withdrawal during molding and lead for precisely relocating the button actuator means 54 during each reciprocation. The depending bevel surface 144 of the interior of the cover means 44 (see FIG. 12) has similar characteristics. Depending interior vertical surfaces 146, 148, 150, 152 in rectangular array provide the major surfaces of the cover means 44 for the key way channel for receipt and movement of complimentary surfaces formed in the actuator means 54 as shown in FIGS. 17–20.

The cover means 44 may be disassembled from the base means 42, if after initial assembly testing discloses some problem, by a spreading of the legs 112 and 114. Thus modification may be made and the switch need not be destroyed. The cover means may also be glued to the base means in final assembly. If a sealed switch is required, a hat shaped thin limp rubber or other flexible membrane cover means 55 ma be glued to the surface 116 as shown in dotted lines in FIG. 2 without degrading the other Mil. Spec. characteristics.

Figure 14:
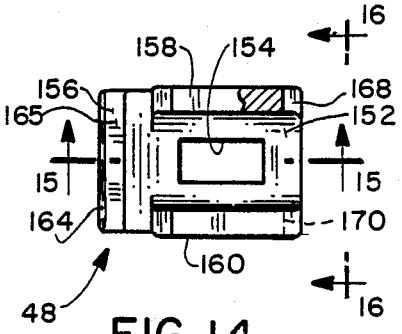
FIG. 14 is an end view, partially in section, of the yoke that is to be attached to a fixed terminal and the base, said yoke being shown in isolation.
Figure 15:
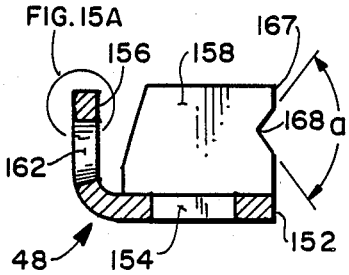
FIG. 15 is a sectional view of the yoke along lines 15—15 of FIG. 14.
Figure 16:
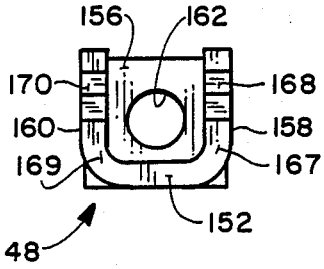
FIG. 16 is an end view along lines 16—16 of FIG. 14.
Figure 17:
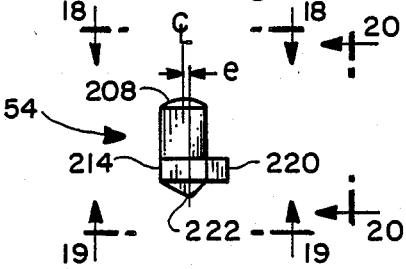
FIG. 17 is a side elevational view of the actuating button shown in isolation.
Figure 18:
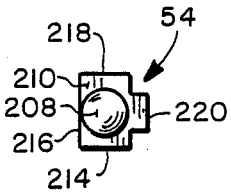
FIG. 18 is a top view along lines 18—18 of FIG. 17.
Figure 19:
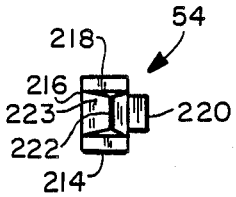
FIG. 19 is the bottom view of the button shown along lines 19—19 of FIG. 17.
Figure 20:
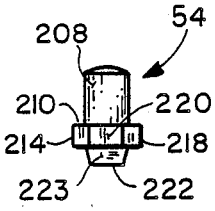
FIG. 20 is an end view shown along lines 20—20 of FIG. 17.

The yoke means 48 shown in FIGS. 14, 15 and 16 serves the several functions of providing the anchor for one end of coil spring means 52, provides the precision pivotal points of the combination switch blade and contact means 50 and is a part of the electrical common contact means of the switch. The FIGS. 14–16 are drawn in exaggerated size to show details, the relative size being more clearly shown in FIGS. 1–3. The yoke means 48 is an important structural component and must be relatively strong. It must take the compressive/tensile forces of the movable contact means and the coil spring means 52 through 100,000 actuations without fatigue and maintain its dimensional integrity. It is preferably formed of Be Cu from approximately 0.0126 inches thick sheet stock which meets Mil C-B1021.

The yoke means 48 may be formed by precision stamping so as to form the base portion 152 with a rectilinear opening 154 which is made to precisely fit over ears 86 and 88 and rectilinear portion 90 to engage the sides of the opening 154. The ear 84 and 86 are spread to provide swaging attachment to terminal/contact means 62 and form a good electrical and mechanical connection of the yoke means 48 to the common terminal means 62. It is important that opening 154 be made very precisely so that upstanding end tab 156 and spaced side tabs 158 and 160 are located precisely relative to the aforedescribed components. Given the absolute size of the yoke means (approx. 0.100 inches long, 0.073 inches wide (plus or minus 0.002) and 0.067 inches high) the yoke means 48 is formed in a quite sturdy manner to perform the anchoring and the pivoting functions.

Figure 15A:
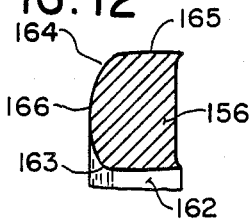
FIG. 15A is an enlarged sectional view of a detail of FIG. 15.

As shown in detail in FIG. 15A, a spring anchor bore 162 is formed in end tab 156 and has a curvilinear upper edge spring engagement surface 164 formed in the top edge 165 of tab 156 for cooperation with an end of coil spring means 52. Also a curvilinear margin 163 is formed in bore 162 at the outboard edge 166 as viewed in FIG. 15. The preferred method of forming these curved surfaces 164 and 166 will be described later with respect to FIG. 25. It is the nature of the construction described respecting the bore 162 and the top surface 165 that the anchor end of coil spring means 52 will have a selfcentering action at a fixed location and a reduced "walking" characteristic as well as good pivoting action between the position shown in FIGS. 1 and 2 (actuation).

The forward edges 167 and 169 of side tabs 158 and 160 are formed with V shaped notches 168 and 170 having a divergence angle (a) as shown of approximately 110 degrees for receipt of the spaced pivotal edges of the combination switch blade and contact means 50. The notches are located in vertical height below the height of the uppermost edge of the bore 162 as seen in FIGS. 1 and 2. The outboard edges of tabs 158 and 160 are spaced apart slightly less than the side walls of the interior of the cover means 44, and if the cover is at minimum tolerance and the tabs 158 are spaced at maximum tolerance there is a press fit (no clearance). If the parts are made to exact nominal specification then there is a nominal design clearance of 0.001 on each side. The side walls of the cover means 44 adjacent to the notches 168 and 170 become the stop/centering means to maintain the combination switch blade and contact means in working relationship in notches 168–170.

The actuator means 54 and its structure and cooperations will be later described.

Figure 21:
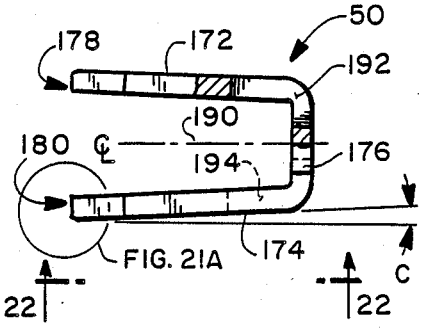
FIG. 21 is a top view, partially in section, showing in isolation the preferred embodiment of unitary switch blade and contact means.
Figure 22:
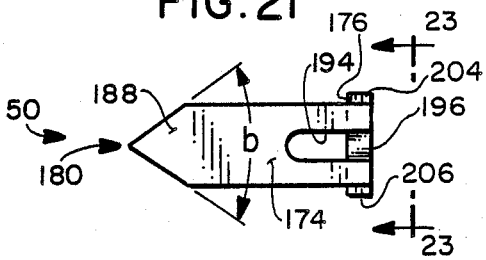
FIG. 22 is a side elevational view of the unitary combination switch blade and contact means taken along the lines 22—22 of FIG. 21.
Figure 23:
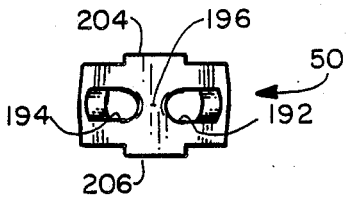
FIG. 23 is an end elevational view of the combination switch blade and contact member along lines 23—23 of FIG. 22.

The movable combination switch blade and contact means 50 is shown in FIGS. 21–23 and is preferably formed from sheet stock. It must be both sturdy, electrically conductive and heat conductive. It must have mass to accept some erosion at the contact surfaces and still be electrically operative to meet specification criteria after electrical and mechanical cycling for many thousands of cycles. It must not be so massive that it cannot withstand shock tests of 100 g forces or the military vibration tests aforenoted. One material found satisfactory for the combination switch blade and contact means is an alloy of silver, magnesium and nickel sold under the tradename H & H CONSIL 995 strip, with a sheet thickness 0.010 plus or minus 5 10/1000ths of one inch, half hard.

The structure will be discussed prior to discussing some important aspects of the method employed to make the combination switch blade and contact means 50. As best seen in FIGS. 3 and 21 a basic structural characteristic of the switch blade is the uniform size in constructional thickness. The blade/contact means 50, after stamping from sheet stock, is formed into a generally U-shaped form having spaced legs 172 and 174 connected by a bail portion 176. It is one axis symmetrical in final construction so as to not require orientation in assembly to the yoke means 48. As shown in FIG. 22 the vertical height of the legs 172 and 174 is several times greater than the thickness. The legs 172 and 174 are bent from the major plane of bail portion 176 a few degrees less than 90 degrees (angle c) so that the legs 172 and 174 diverge slightly, angle c being on the order of 6.8 degrees and the tip means 178 and 180 of legs 172 and 174 are spaced apart approximately 0.073 inches plus or minus 0.003 inches.

Figure 21A:
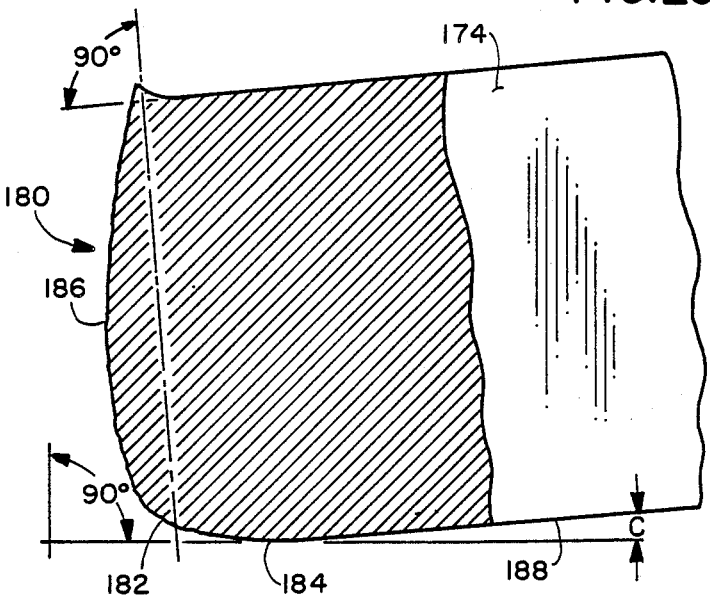
FIG. 21A is an enlarged detail of a portion only of FIG. 21 (as shown by the enlargement circle)

The portion of the tip means shown in FIG. 21A is shown approximately 100 X size. Only one shall be described as they are mirror image identical. As best seen in FIGS. 21A and 22, each tip means 178 and 180 is formed with a generally curvilinear surface 182 joining generally transverse surfaces 185 and 188 so that a curved portion 184 of the tip means 180 is furthest spaced from the center line 190 of the movable switch blade and contact means 50. As viewed from the side in FIG. 22, the tip means 178 and 180 of each end of the legs 172 and 174 is V shaped having an included angle (b) which is on the order of 70 degrees. Thus there is clearance for pivotal movement in V shaped notches 168 and 170 of the yoke means 48 when assembled as shown in FIGS. 1 and 2. Because of the force of the coil spring means 52 urging tip means 178 and 180 into the V notches 168 and 170 there is very little electrical resistance at this junction.

The tip means 178 is formed in mirror image to tip mean 180 and thus portions 184 of each tip means 178 and 180 become the outboard edges of blade/contact means 50 as measured transversely to center line 190 and become the self centering points for coaction with the cover means 44. Points 184 are located only a few thousandths of an inch away from angularly disposed pivotal edge 186 which is the pivotal edge for location in the base of the notches 168 and 170 of the yoke means 48. While surface 186 looks somewhat jagged in FIG. 21A, in ordinary perception it is generally and substantially parallel with bail portion 176 and would appear to be a relatively smooth knife edge to the naked eye. It will mate quite well with the bottom of notches 168 and 170. Any fragile extensions on the surface 186 are on the order of tens of thousandths or millionths of an inch and are distorted to a quite smooth surface upon assembly of the blade/contact 50 to the construction shown in FIG. 1. Points 184 on the leg tips 178–180, due to their location and shape, will provide a non jagged surface to provide low friction rubbing self centering relationship when engaging the interior side walls of the cover so as to not interfere with the operating characteristics of the switch.

Figure 24:
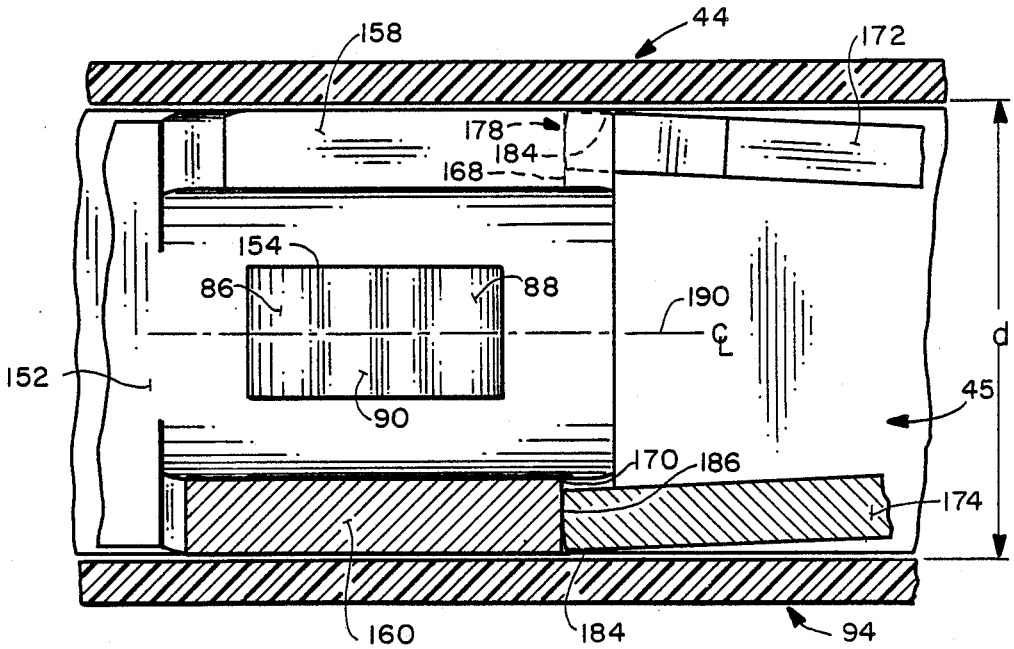
FIG. 24 is an enlarged view showing the coaction of the pivotal edges of the unitary combination switch blade and contact means with the yoke means, said view being partially in section and with the coil spring removed.

FIG. 24 is enlarged substantially to show the relationship of the parts and the close packing in horizontal array required for the assembly. From the top to the center line 190 there are cover means 44 side wall, clearance, leg 158 and tip means 178, clearance, coil spring means 52 (not shown in FIG. 24, see FIG. 3), and below the coil spring means, a mounting lug 90 of the terminal/contact means 62 and the assembly clearances for the rectilinear aperture 154 in the base 152 of the yoke means 48. Thereafter from the center line 190 in reverse order are the same parts and clearances all fitting into an internal chamber means 45 of dimension (d) which is on the order of 0.076 inches. By using the cover means 44 side walls as the centering means for the tips 178 and 180, no separate tolerances are required over those needed to assemble the cover means 44 over the yoke means 48. The curved surface points 184 which may engage the side walls of the cover means 44 are closely located (on the order of a few thousandths of an inch) to pivotal end surface 186 and therefore the couple provided by frictional force on the cover is of low amount since it has a very short lever arm. The frictional force in centering is thus negligible in comparison when considered with the force associated with the coil spring means 52 attached to the bail 176 which is operating through a long lever arm.

Figure 25:
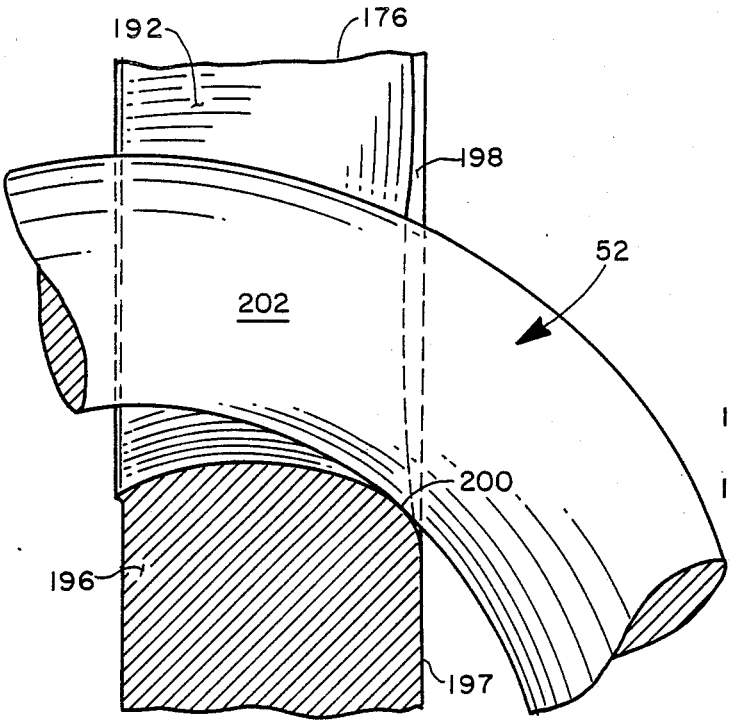
FIG. 25 is an enlarged partial sectional view showing the coaction at the connection of the coil spring to the web between the slots in the bail of the U-shaped combination switch blade and contact means.

The legs 172 and 174 are formed with symmetrical slot means 192 and 194 as shown and which extend into the U-shaped bail portion 176 to define a mirror image hour glass shape curvilinear edged web portion 196 as viewed in FIG. 23 and FIG. 25. As shown in FIG. 25 in greatly enlarged detail, the outboard surface 197 of the bail 196 is curved at the juncture with the slot means 192 and 194 to provide a saddle like surface with point 200 being the definitive locational point for the pivotal action of the coil spring means end 202. Thus a low wear, low friction coil spring pivoting anchor engagement is provided at point 200 during the pivoting action of the switch blade and contact means 50 (see FIG. 25).

The slot means 192 and 194 reduce the mass of the bail portion 176 and the legs 172 and 174 at the portion of the legs remote from the pivot edges on the tips 178 and 180. This provides less inertia force on the blade/-contact means 50 in meeting the needed shock and vibration specification characteristics for this high performance switch. The slot means 192 and 194 have a geometry which allows good heat conduction on the portions of the blade/contact means 50 above and below the slot means 192 and 194 to provide good integrity of shape and dimensional stability to the blade and contact means 53 for meeting mechanical and electrical specification requirements. The bail portion 176 has raised portions 204 and 206 at the top and bottom which are the upper and lower contact areas and which have "extra stock" for fast conduction of heat and to accommodate to some erosion. The slot means 192 and 194 provide the access for assembly of the end 202 of the coil spring means as shown in enlarged view of FIG. 25.

The similarity of the curved nature of surfaces means engagement point 200 on the bail portion and the curved surfaces on tip means 178 and 180 will be noted. They are caused by making the stamping tool approach the bail portion 176 from the direction of outer surface 197 and then move inwardly. With respect to the tip means 178 and 180, its movement is from the outer surface 188 (see FIG. 21A) toward the inner surface. The shearing action of the stamping tool causes a slight pulling/stretching/rounding of the edge surface. Since the size and geometry of the parts here involved are so minute, the grinding or machining of rounded surfaces would be very difficult and expensive. By making use of the pulling/stretch characteristics of the stamping/shearing action, and thereafter bending the legs 172 and 174 toward the burr edge (edge opposite rounded edge), the high precision switch blade and contact means 50 is formed and the curved surfaces such as 182 are made without secondary operations and are available for their aforedescribed multiple functions. The upstanding lug 158 of the yoke means is also bent in the burr direction (both the top surface of lug 158 and the bore 162 are formed by having the shearing tool engage the yoke material from the same direction) resulting in an anchor/pivot point for the connection to the coil spring means 52 that is formed in the same manner as the blade/contact means 50. This method of forming both the blade contact means 50 and the yoke means 48 is very advantageous in providing a long mechanical life switch in a relatively low cost manner given that they are of such small size and such high precision.

It will be noted that mechanical contact/pivot point 200 of the blade/contact means 50 with the end 202 of the coil spring is adjacent outer surface 197, but is inwardly of the outer surface area, and puts the pivotal connection with coil spring end 202 within the thickness of the material which defines the upper and lower contact areas 204 and 206. This makes for a borderline class 2 lever system. Stated another way, the lever action from the tip means 178–180 may be on the edge of being a second class lever or it may be considered that the contact surfaces 204–206 are essentially coplanar with the pivot point 200. In either event of coplanar or second class levering system, very high contact force is generated (of a minimum of 15 grams) which provides little or no discernable bounce on make after overcentering of the switch.

As viewed in FIGS. 1–3 it will be seen that there is very tiny clearance above that needed for dielectric spacing between the end 202 of the coil spring and the vertical portion 78 of the upper contact. To make the web between the slot means 192–194 extend beyond the plane of surface 197 (which increases mechanical advantage of the lever system employed) would be at the sacrifice of room for an active coil of the coil spring means and would otherwise affect the essential geometry and spacing of components. The formation of the web for spring attachment to give the desired saddle geometry when moving outboard of the surface 197 is also difficult to accomplish at low cost. A blade of the geometry shown in FIGS. 7–10 of Roeser Pat. No. 3,612,793 is not operable in this switch mechanism when it is downsized because, inter alia, the coil spring means 52 would be too small in diameter for effectiveness even assuming it would be capable of being manufactured.

The actuator means 54 has a top surface 208, a rectilinear midportion 210 with end surfaces 214, 216 and 218 and a formed extending portion 220. The bottom is formed with a depending slanting surface 223 lug terminating in an end surface 222 which is offset from the center line of portion 208 a dimension (e) toward portion 220. The rectilinear portions of the button cooperates with the channel and keyway surfaces of the cover means 44.

Reciprocation of button actuator 54 causes depending surface 222 to engage a coil and in turn move the line of action of coil spring means 52. This causes the overcentering action required for snap action. The over center position as is shown in FIG. 2 causes the switch blade and contact means 50 to move to the lower contact engagement. The point where edge 222 engages the coil spring, is the "sweet spot", and the center line of the button top 208 is a user specification requirement. It would be preferable that the center line of 208 and portion 222 were colinear. It should be noted that rather than compromise of the spring lengths to make the engagements of surface 222 colinear with the button, every bit of active length of coils of springs 52 are needed to be able to provide needed characteristics of the high performance switch and thus the offset.

As seen in FIGS. 1–3, the coil spring means after assembly, is longer than the dimension between the lug 158 of the yoke means and surface 197 of the blade/contact means. Coil spring means 52 is in some respects a limiting factor in terms of what can be wound into a precision coil shape using todays technology. By precision coil shape, it is meant that a plurality of coil means 52 can be wound so that they have near identical coil means to coil means similarity so that the characteristics are interchangeable and reliable. In the instant construction it will be seen that the coil spring means 52 dominates the width of the interior 45 of the envelope. It occupies close to 50% of the usable total space interiorly of the chamber 45. It also has a length on the order of 83% of the available interior space. In short, while other parts of the switch construction may be downsized, the spring or coil means 52 is at the near limits of smallness of size presently possible. When it is given that 15 grams of contact force on the movable contact means is necessary for a reliable high performance switch, the size of the coil spring means becomes an important and limiting factor. When high contact force is required along with the low movement differential (0.004 inches or less), the important influence that the coil spring means 52 plays as a part of the total structure is illustrated.

Figure 26:
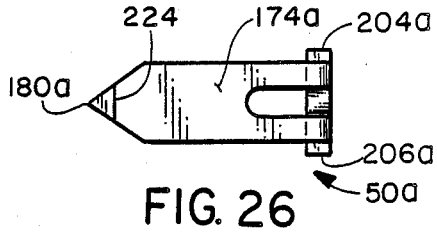
FIG. 26 is a side view of an alternate form of combination switch blade and contact means.
Figure 26A:
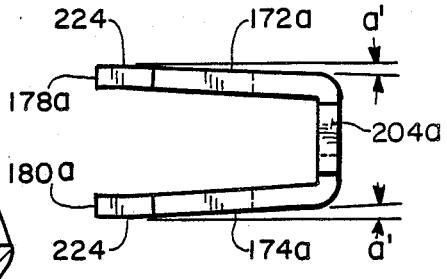
FIG. 26A is a top view of the alternate switch blade and contact means shown in FIG. 26.
Figure 27:
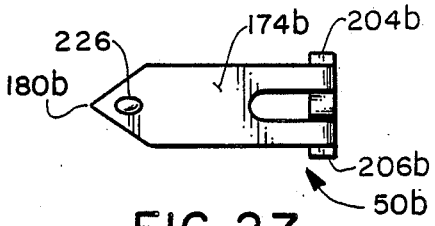
FIG. 27 is another alternate showing of a variation of the combination switch blade and contact means.
Figure 28:
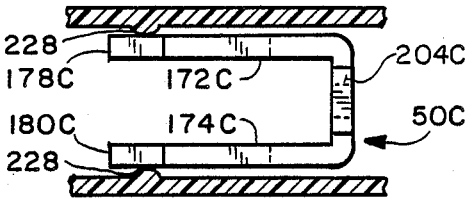
FIG. 28 is an alternate form of structure to show an alternate form of cooperation of the cover and the combination switch blade and contact means.

Alternate forms of switch blade and contact means are shown in FIGS. 26 through 28 and similar parts will be shown with similar reference numbers with the addition of suffixes a, b and c to relate to the different alternate embodiments shown.

Figure 27A:
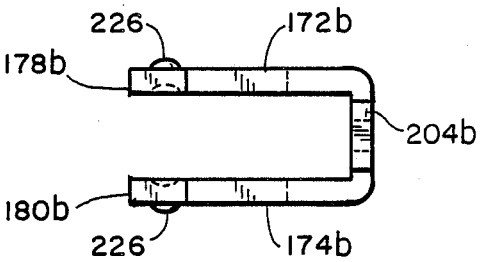
FIG. 27A is a top view of the alternate shown in FIG. 27.

The alternate type of switch/blade contact means 50*a* has the tip means 178*a* and 180*a* bent inwardly so that edge 224 becomes the outboard edge for centering of the blade/contact means on the cover means interior side walls. While this moves the centering point a few thousandths of an inch from the pivotal edges it is still overwhelmed by the forces at the contact portions 204*a* and 206*a*. The type b form of alternate has a hump 225 distorted out of the plane of the leg material in each leg means as shown. It will be observed that the legs 172*b* and 174*b* are essentially parallel and the humps 226 extend outwardly only a distance of 0.002 inches from the plane of the outboard edges. FIG. 28 shows a mirror image constructional concept to that shown in FIG. 27A with the humps 228 being on the cover for centering contact with the legs 172*c* and 174*c*.

It will be observed that in all embodiments of the switch blade, a relatively large in diameter coil spring means 52 may be used, i.e. it is possible to use a coil spring which occupies approximately 50% of the width of the interior space of the enclosure for the switch (see FIG. 3). It also is possible with each form of switch blade and contact means to have the coil spring occupy approximately 83% of the interior space length. A powerful spring means is a key component for the precision characteristics of this tiny switch and by the construction of the blade/contact means 50, 50*a*, 50*b* and 50*c* as discussed, a relatively large spring means 52 may be used.

The specifically discussed embodiments aforedescribed are to be considered illustrative and the essence of the invention is to be considered to be embodied in the appended claims.

We claim:

1. A unitary combination switch blade and contact means for a tiny rugged relatively large current carrying high precision snap switch having a length less than ⅓ of an inch and a width less than ⅛ of an inch and having a switch blade centering means therein connected to a common conductor, said switch blade comprising a member sized to be mounted with said snap switch and being characterized as a. a one piece member formed solely from a single piece of material, b. being of electrically conductive material, c. having a generally U-shaped configuration in top view, d. formed with first and second spaced legs connected by a bail portion, e. said bail portion being characterized as having a material thickness and a material height, whereby said material height is greater than and transverse to said material thickness, said bail portion having a spring attachment means portion, f. said first leg comprising first centering means and a first end section remote from said bail portion, g said second leg comprising a second centering means, and a second end section remote from said bail portion, h. said first and second centering means being remotely spaced from each other and each being adapted to be cooperable with device centering means, said device centering means being non integral to said switch blade and contact means, i. said first and second centering means adapted to be operable with and said device centering means to provide a low friction engagement therebetween, and j. each of said first and second end sections is formed for an electrical current carrying pivotal relationship to said common conductor, whereby a relatively large current carrying capacity switch blade for high precision tiny snap switches is provided.

2. The switch blade set forth in claim 1 wherein the first and second legs away from each other.

3. The switch blade set forth in claim 1 wherein said first and second centering means are respectively located remotely to said bail portion, and said device centering means comprises interior wall surfaces.

4. The switch blade of claim 1 wherein the distance between said first and second end sections is less than 1/10th of one inch.

5. The switch blade of claim 4 wherein said distance is less than 6/1OOths of one inch.

6. The switch blade of claim 1 wherein said material of said bail portion is less than 5/1OOths of an inch and exceeds the said material thickness by a factor of at least 4.

7. The switch blade of claim 1 wherein said bail portion has an upper edge portion and a lower edge portion, said upper edge portion being an upper contact and said lower edge portion being a lower contact.

8. The switch blade of claim 1 wherein said first and second legs each have a materials height and a material thickness, whereby said material height is greater than and transverse to said material thickness.

9. The switch blade of claim 1 wherein said material is of substantially uniform thickness, substantially non flexing/rigid construction and formed from sheet stock.

10. The switch blade of claim 1 wherein said spring attachment means is located in said bail portion at a midposition intermediate said first and second leg portions.

11. The switch blade of claim 1 wherein said first and second centering means are each located in a first plane, substantially parallel to each other, and are of knife edge configuration, said first plane is disposed transversely to a second plane, said second plane bisecting said spring attachment means and said bail portion.

12. The switch blade of claim 11 further characterized in that each of said first and second legs has an inner surface and an outer surface, said inner surface and outer surface each being generally transverse to said first plane, said outer surface of each of said knife edge configurations forms the surface area of said first and second centering means, said first and second centering means formed from the outer surface toward the inner surface to provide a curvilinear junction of said knife edge configuration.

13. The switch blade of claim 12 wherein each of said curvilinear junctions are formed by advancing a stamping tool from said outer surface toward said inner surface in the formation of said knife edge configuration.

14. The switch blade of claim 1 wherein said bail portion forms first and second extensions, at a midpoint therein, said first extension forming an upper contact surface and said second extension forming a lower contact surface, said first and second extensions each being configured and arranged to form a heat sink to quickly remove heat caused by make or break of an electrical contact at said upper and lower contact surfaces.

15. The switch blade of claim 1 wherein said material is a silver metal alloy sheet stock precision stamping having good electrical and heat conducting properties.

16. The switch blade of claim 1 wherein said bail portion has an upper contact surface and a lower contact surface at opposite edges of said bail portion, and first and second leg sections from form first and second elongated slot means spacedly at a location proximate said bail portion and are separated by a web means, said first slot means being circumferentially continuous and extending through a portion of said first leg section proximate said bail portion and formed so as to permit sufficient electrical and heat conducting pathways at all portions of said first leg section thereabout said second slot means being circumferentially continuous and extending through a portion of said second leg section and said bail portion and formed so as to permit sufficient electrical and heat conducting pathways at all portions of said first leg section thereabout, said web means forming both said spring attachment means portion and a pathway to rapidly conduct heat away from both said upper contact surface and said lower contact surface, said first and second elongated slot means reduces the mass of said switch blade in areas remote from each of said electrical current carrying first and second end sections whereby a relatively large electrical current may be transferred by said switch blade while providing very good vibrational, shock, and g force stability and low degradation of the upper and lower contact surfaces from electrical arcing during make and break switching.

17. The switch blades of claim 16 wherein said bail portion is formed with an inner surface and an outer surface, said inner surface and said outer surface each being substantially transverse to said upper and lower contact surfaces of said bail portion, said outer surface adjacent the first and second slot means, the web means formed in a curvilinear shape for cooperation with the spring attachment means, to reduce friction and abrading wear, to provide self centering means, and provide a well defined pivotal attachment location for the spring attachment means.

18. The switch blade of claim 17 wherein a portion of said curvilinear surface is formed by a stamping tool in the formation of the elongated first and second slot means, said stamping movement being in direction that causes a shearing and shifting of material from said outer surface toward said inner surface.

19. A snap switch mechanism comprising:

(a) a movable contact means, (b) switch envelope means formed of insulating material having a first portion and a second portion, said first portion and second portion being cooperable to form an enclosure for said movable contact means;

(c) first, second and third fixed contact means fixedly disposed to said first portion and each respectively having interior and exterior sections, said interior section of said first fixed contact means being an upper contact, means said interior section of said second fixed contact means being a lower contact means, and said interior section of said third contact means being a common contact means, said upper and lower contact means being spaced apart a first distance;

(d) movable contact means mounted on said third contact means for movement between said upper and lower contact means;

(e) coil spring means having a coil diameter and having a first and second ends, said first end being engagable with said movable contact means and said second end being engagable with said third contact means, said coil spring means extending between said movable contact means and said third contact means to bias said movable contact means into engagement with said first fixed contact means;

(f) actuator means movably extending through said second portion for engagement with said coil spring means to cause movement of said movable contact means;

(g) said movable contact means being characterized as being formed solely from sheet metal stock of predetermined thickness and characterized as a stamping having a generally U-shaped con figuration when viewed in a plane substantially transverse to said predetermined thickness, first and second spaced connected by a bail portion, said first and second leg portions being pivotally connected to said third fixed contact means, said bail portion having upper and lower edge portions spaced apart a distance defining a material height, said upper and lower edge portion respectively providing spaced apart upper and lower contact surfaces for engagement respectively with said first and second fixed contact means, said material height substantially greater than and transverse to said predetermined thickness and less than said first distance.

20. The snap switch set forth in claim 19 having said upper and lower contact surfaces spaced apart a dimension greater than said coil diameter.

21. The snap switch set forth in claim 19 wherein said first and second legs are spaced apart a dimension greater than said coil diameter, said coil spring means being disposed between said first and second legs.

22. The snap switch set forth in claim 19 wherein said first and second legs each have a height when measured generally transverse to said predetermined thickness, said height being several times the said predetermined thickness.

23. The snap switch set forth in claim 19 wherein said coil spring means is pivotally connected to said bail portion, said bail portion having a proximate and a remote surface with respect to the pivotal connections of said movable contact means with said third fixed contact means, said spring means pivotal connection being adjacent said remote bail surface to afford a lever action connection, said lever action connection is collinear to a third class lever action connection between said coil spring means and said movable contact means.

24. The switch of claim 19 wherein said coil spring means is formed having first and second oppositely disposed end portions, each of said end portions terminate in a hook portion and are disposed in 90 degree angular relationship to each other.

25. The switch of claim 24 wherein said third contact means and said movable contact means are each formed with a curvilinear surface for pivotal connection with said hook portions of said coil spring means.

26. The switch of claim 19 wherein said actuator means extends exteriorly of said second portion and has an actuation engagement, portion said actuator means being formed with a center line and being reciprocatingly movable along said center line, said actuator means also formed with a coil spring engagement portion, said coil spring engagement portion being offset from said center line.

27. The switch set forth in claim 19 wherein said second portion is generally rectilinear in shape, has thin walls defining an internal chamber and is formed with oppositely disposed depending tab attachment portions, the said internal chamber having a length less than 0.290 inches and a width less than 0.080 inches which surrounds said interior portions of said first, second and third contact means and said coil spring means.

28. The switch mechanism of claim 19 further comprising first and second portion latch attachment means for latching said first and second portions of said switch envelope means, said first and second portion latch attachment means comprising, first and second attachment portions formed in said first and second portions, said first attachment portion is a cylindrical pin having a diameter surface and an end surface, said second attachment portion is a receptacle means having a surface with a shape complimentary to the diameter of said cylindrical pin means, said end surface having a cam portion means and a back up portion means whereby said cam portion means aids latching assembly of said first and second portions of s id switch envelope and said back up portion means prevents distortion of said cylindrical surface whereby a quick latching assembly of the first and second envelope portions may be made with high precision.

29. The switch mechanism of claim 19 wherein the switch is very thin in physical size having a weight of less than 0.003 pounds, formed with an outer envelope width of less than 0.108 inches and a length of less than 0.311 inches, formed with very rugged mechanical characteristics and being operable to withstand 100 G of shock without actuating, and operable to switch at sea level a current of in excess of 1 Amp. at 115 VAC, 60hz and 28VDC in excess of 5,000 actuations.

30. A snap switch mechanism comprising:

(a) a movable contact means, (b) switch envelope means formed of insulating material having a first portion and a second portion, said first portion and second portion being cooperable to form a enclosure for said movable contact means;

(c) first, second and third fixed contact means fixedly disposed to said first portion and each respectively having interior and exterior sections, said interior section of said first fixed contact means being an upper contact means, said interior section of said second fixed contact means being a lower contact means, common contact means;

(d) movable contact means mounted on said third contact means for movement between said upper and lower contact means;

(e) coil spring means having a coil diameter and having a first and a second end, said first end being engagable with said movable contact means and said second end being engagable with said third contact means, said coil spring means extending between said movable contact means and said third contact means to bias said movable contact means into engagement with said first fixed contact means;

(f) actuator means movably cooperable with said first and said second portions for engagement with said coil spring means to cause movement of said movable contact means;

(g) said enclosure for said movable contact means having an internal width and an internal length, said internal length being at least 3 times said internal width;

(h) said first and second ends of said coil spring means being spaced apart a coil length dimension, said coil length dimension being more than 75% of said internal length; and (i) said movable contact means being configured and arranged into a generally U-shaped rigid member having a bail portion having upper and lower contacts thereon and a pair of spaced apart legs, said coil diameter being greater than 40% of the said internal width, said first end of said coil spring means being connected to said bail portion, whereby a high contact force contact with said first and second contact means will be imparted to said upper and lower contacts on said bail portion.

31. The switch of claim 30 wherein said pair of legs are spaced apart a dimension greater than said coil spring diameter and said coil spring means is located therebetween.

32. The switch of claim 30 wherein at least 66% of the coil spring means length are active coils 33. The switch of claim 30 wherein the movement differential of said movable contact means is 0.004 inches or less.

34. The switch of claim 33 wherein there is a minimum of 0.015 inches of pretravel of the actuator means prior to causing said movable contact means to move.

* * * * *